US012679506B2

(12) United States Patent
Dow et al.

(10) Patent No.: US 12,679,506 B2
(45) Date of Patent: Jul. 14, 2026

(54) TEMPORARY BARGE OR BOAT HATCH INSERT FOR FACILITATING VOID SPACE

(71) Applicant: Dow Solutions, LLC, Pittsburgh, PA (US)

(72) Inventors: Justin Dow, Monroeville, PA (US); Erik Arlet, Pittsburgh, PA (US)

(73) Assignee: DOW SOLUTIONS, LLC, Pittsburgh, PA (US)

( * ) Notice: Subject to any disclaimer, the term of this patent is extended or adjusted under 35 U.S.C. 154(b) by 325 days.

(21) Appl. No.: 18/457,154

(22) Filed: Aug. 28, 2023

(65) Prior Publication Data

US 2024/0067306 A1 Feb. 29, 2024

Related U.S. Application Data

(60) Provisional application No. 63/401,450, filed on Aug. 26, 2022.

(51) Int. Cl.
*B63B 19/14* (2006.01)
*B63B 57/04* (2006.01)

(52) U.S. Cl.
CPC ..... *B63B 19/14* (2013.01); *B63B 57/04* (2013.01)

(58) Field of Classification Search
CPC ..... B63B 19/04; B63B 19/14; B63B 57/04; B63J 2/08
See application file for complete search history.

(56) References Cited

U.S. PATENT DOCUMENTS 2,776,070 A * 1/1957 Phillips ..... B61D 7/00 220/203.11
6,085,664 A * 7/2000 Early ..... B65D 90/10 105/377.07
2016/0356521 A1* 12/2016 Bertini ..... F24F 13/02

* cited by examiner

*Primary Examiner* — Tye William Abell
(74) *Attorney, Agent, or Firm* — Blynn L. Shideler; Krisanne Shideler; BLK Law Group

(57) ABSTRACT

A temporary hatch insert facilitating void space servicing wherein the hatch insert is sized to be received in a given hatch opening and will support a person walking across the insert in the hatch opening, and wherein the hatch insert includes a plurality of openings for venting or ventilation of the void space during servicing of the same. A fan or blower mount may be secured below the hatch insert to facilitate venting of the void space.

19 Claims, 4 Drawing Sheets

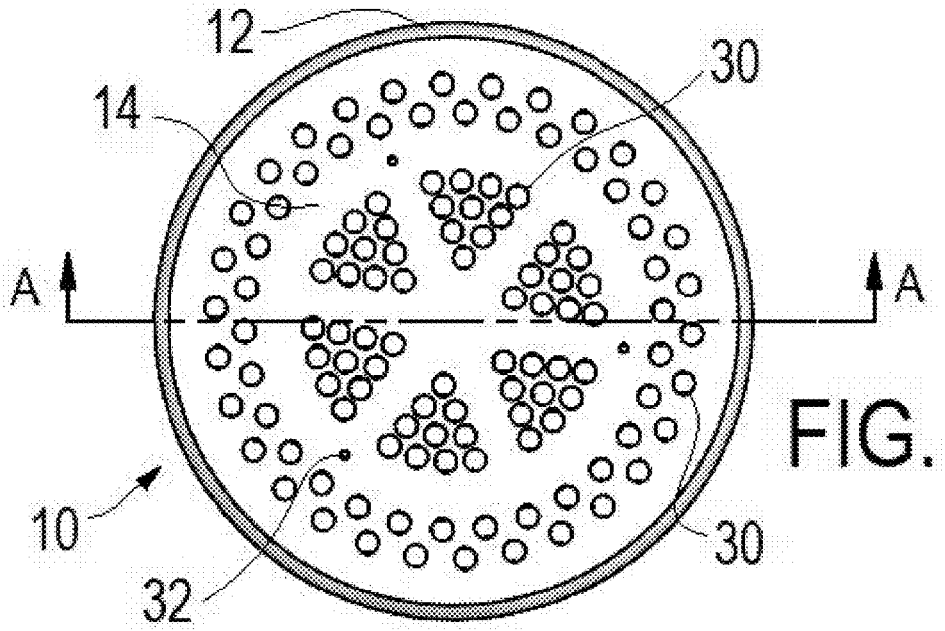
FIG. 3B
FIG. 3C
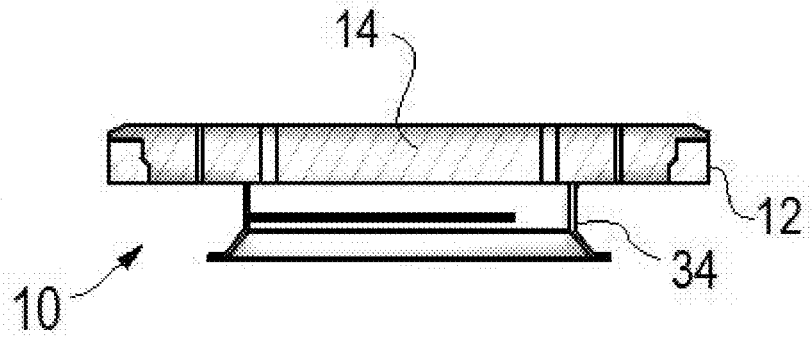
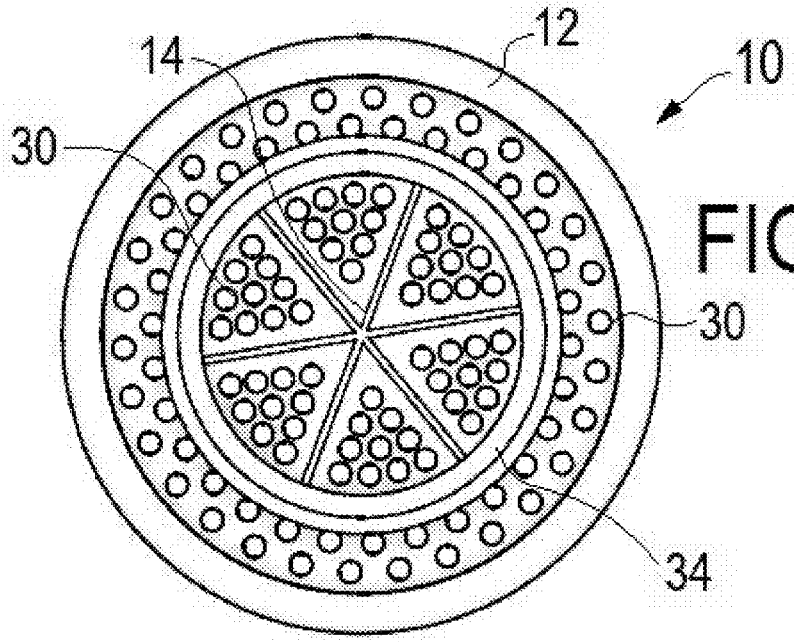
FIG. 3D

TEMPORARY BARGE OR BOAT HATCH INSERT FOR FACILITATING VOID SPACE

RELATED APPLICATIONS

This application claims the benefit of U.S. Provisional Patent Application Ser. No. 63/401,450 filed Aug. 26, 2022 titled "Temporary Barge or Boat Hatch Insert for Facilitating Void Space Service" which application is incorporated herein by reference.

BACKGROUND OF THE INVENTION

1. Field of the Invention

This invention generally relates to marine, barge and boat, hatches during void space servicing.

2. Background Information

In a marine environment a boat hatch or barge hatch is a covering or portal through which the below deck storage, cargo or additional living space or like within a boat or a barge can be accessed from the boat deck. Within this application the below deck storage, cargo or additional living space or like is collectively references as void spaces. A well-constructed boat hatch must be waterproof, support the weight of people and objects placed on it, and must weather the elements to the same degree as the rest of the associate a deck.

These boat or barge hatches will be open for servicing of the void spaces. Typically during void space servicing, the hatch lid would be removed and the hatch "entrance" would be open, a technician or repair service person would enter the void space to conduct inspections and/or repairs. During this servicing of the void space, the hatch opening typically is left open for ventilation requirements. For example, these often need to be left open for venting gases, fumes, etc., associated with welding, or other repairs. This requirement leads to the open hatch to be susceptible to person(s) falling into the opening causing severe injury or even death. This danger is exacerbated during an entire boat or barge overall in which multiple procedures in distinct areas of the craft may be worked upon simultaneously with separate personnel.

There is a need to facilitate void space servicing and minimize the above cited hazards.

SUMMARY OF THE INVENTION

The various embodiments and examples of the present invention as presented herein are understood to be illustrative of the present invention and not restrictive thereof and are non-limiting with respect to the scope of the invention.

This invention generally relates to light weight temporary barge or boat hatch insert that would be used as a temporary "hatch lid" while work was being performed in the void space. The inserts are sized to fit the existing hatch and create a safe walking environment, as well as providing ventilation, including exhausting fumes or gases.

One aspect of the present invention provides a method of facilitating void space servicing comprising the steps of a) Providing a temporary hatch insert including
   i) A frame sized to be received in a given hatch opening and defining an open area;

ii) An insert body extending from the frame and covering the open area and configured to support a person walking across the insert in the hatch opening; and
   iii) a plurality of openings through the insert body for venting or ventilation of the void space during servicing of the same;
b) placing the temporary hatch insert within the given hatch opening during servicing of a void space accessed by the hatch opening for support of a person walking across the insert in the hatch opening and for venting or ventilation of the void space during servicing of the same; and
c) removing the temporary hatch insert from within the given hatch opening following servicing of a void space.

One aspect of the present invention provides a temporary hatch insert including hatch frame sized to be received in a given hatch opening and defining an open area; an insert body extending from the hatch frame and covering the open area and configured to support a person walking across the insert in the hatch opening; and a plurality of openings through the insert body for venting or ventilation of the void space during servicing of the same.

These and other advantages of the present invention will be clarified in the following description taken together with the associated figures.

BRIEF DESCRIPTION OF THE SEVERAL VIEWS OF THE DRAWINGS

FIG. 3B is a schematic top plan view of the hatch insert of FIG. 3A.

FIG. 3C is a schematic section view of the hatch insert of FIG. 3A taken along line A-A of FIG. 3B in which a fan or blower mount is evident.

FIG. 3D is a schematic bottom plan view of the hatch insert of FIG. 3A.

The present invention will be described further below in connection with the above described figures and in which like reference numbers represent like elements throughout.

DESCRIPTION OF THE PREFERRED EMBODIMENTS

Figure 1A:
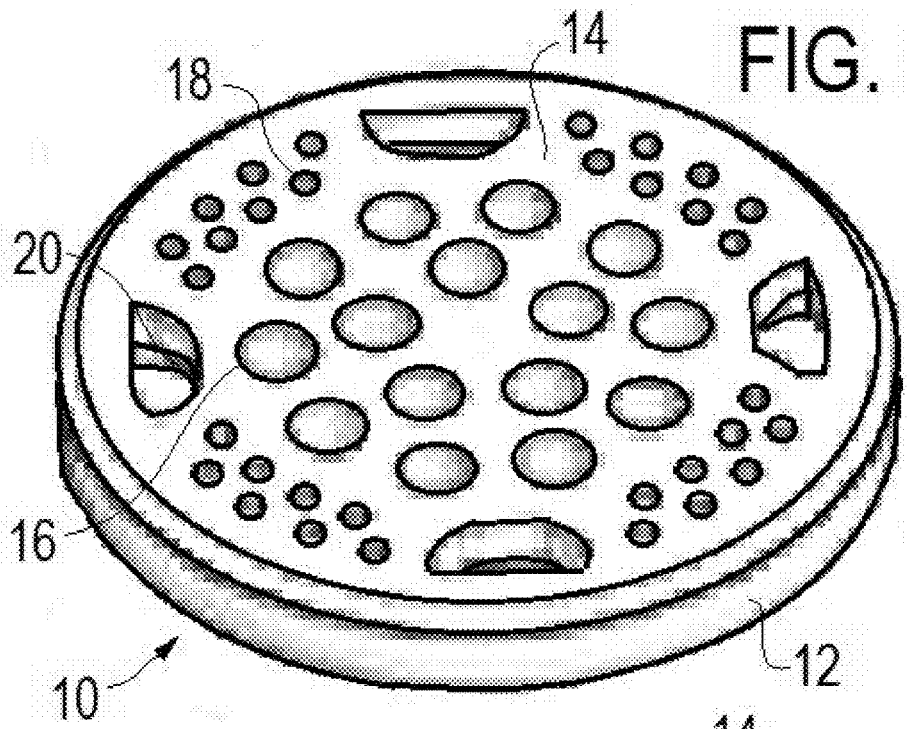
FIG. 1A is a schematic perspective view of a hatch insert according to one embodiment of the present invention.
Figure 1B:
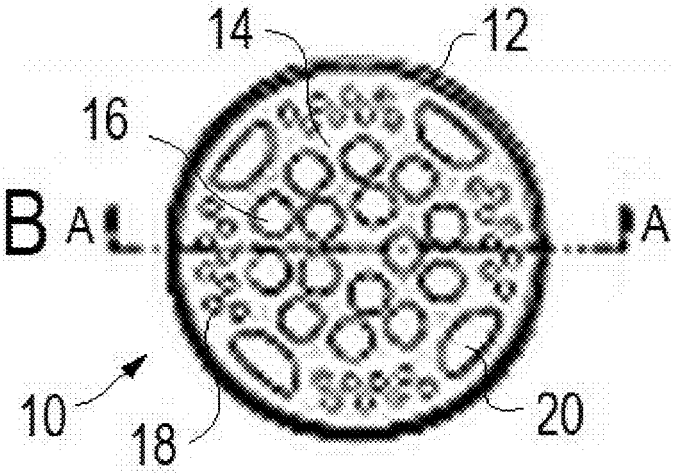
FIG. 1B is a schematic top plan view of the hatch insert of FIG. 1A.
Figure 1D:
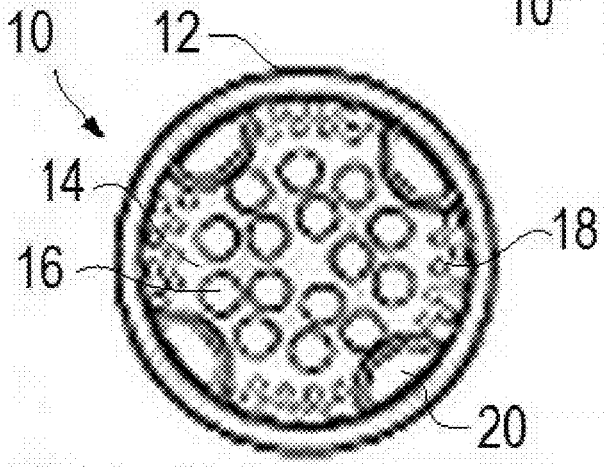
FIG. 1D is a schematic bottom plan view of the hatch insert of FIG. 1A.
Figure 1C:
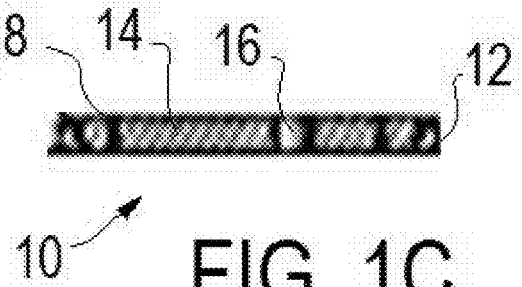
FIG. 1C is a schematic sectional view of the hatch insert of FIG. 1A taken along line A-A of FIG. 1B

As noted above the present invention generally relates to light weight temporary barge or boat hatch insert 10 that would be used as a temporary "hatch lid" while work was being performed in the void space. As noted above a boat hatch is the covering/portal through which the storage, cargo, living space or the like (void space) within a boat can be accessed from your boat deck. A well-constructed boat hatch must be waterproof, must support the weight of people and objects placed on it, and must weather the elements to the same degree as the rest of the boat deck. The inserts 10 of the present invention are sized to fit the existing hatch and create a safe walking environment, as well as providing ventilation for servicing the void space, including exhausting fumes or gases.

FIGS. 1A-D show a perspective view, top plan view, sectional view and bottom plan view of a hatch insert 10 according one embodiment of the present invention. The light weight hatch insert 10 according to the present invention has a peripheral frame 12 that is sized to be received and supported in a given hatch opening and defines or bounds an interior open area. The hatch opening may be circular, rectangular or a variety of specialized shapes. The circular shape shown is a common design shown for convenience. The inserts 10 are lightweight, preferably formed of heavy duty plastic such as UV stabilized polypropylene or PVC. Manway type hatch opening can be easily carried by one worker and manually positioned weighing less than 25 lbs. for most manway openings. The frame 12 will engage with and sit upon the frame of a hatch, also called the hatch opening. The inserts 10 of the present invention are intended to be temporary and used only during serving the associated void space so no attachment or tie down is required.

Extending from the frame 12 is the insert body 14 which will cover the area defined by the frame 12 and which will support a person walking across the insert 10 in the hatch opening. The embodiment of FIG. 1 shows the insert body 14 as a planar plastic plate member. Alternative constructions are possible using a thinner upper body panel with reinforcing ribs for a lighter weight, and such alternative designs for the insert 10 may be beneficial for larger hatches (i.e. small cargo hatches). The upper surface of the insert body may include anti-slip features thereon as it is a walking surface. The insert body 14 may be formed of a bright or neon color to draw attention to the insert for those working on the deck. The insert 10 is designed to accommodate foot traffic, but it may be beneficial to offer reminder to the on deck workers that the void space is being serviced, and a bright/neon color will act as a reminder to remove the insert 10 when servicing is complete.

The hatch insert 10 includes a plurality of openings 16, 18 and 20 for venting or ventilation of the void space during servicing of the same. The openings 16 are circular openings positioned in a dual opening annular array close to the center of the insert body. The openings 18 are circular openings, smaller in diameter than openings 16, and placed in an annular array near the peripheral edge of the insert body 14 adjacent the circular frame 12 and interrupted by four equidistant handle openings. The openings 20 are larger "handle sized" openings near the peripheral edge of the insert body 14 adjacent the circular frame 12. The term handle sized is intended to convey the openings 20 act as handholds for carrying, inserting and removing the insert 10. The openings 16, 18 and 20 create a well ventilated insert 10.

The insert 10 facilitates void space servicing. When servicing a void space accessed by a hatch associated with insert 10 (i.e. the insert 10 is shaped to be received and supported in the hatch), the hatch cover is removed (or merely lifted) and the technician servicing the void space accesses the void space with the needed equipment for inspection or repairs. A worker (or the same technician) places (using openings 20) the insert 10 into position in the open hatch with the frame 12 of the insert engaging the hatch frame and the insert 10 remains in position while the void space is being serviced. Other workers on deck can safely traverse the deck stepping on the insert body 14 of the insert 10 without injury or disruption of the servicing of the void space. The void space is also being ventilated during servicing by way of openings 16, 18 and 20.

Figure 2A:
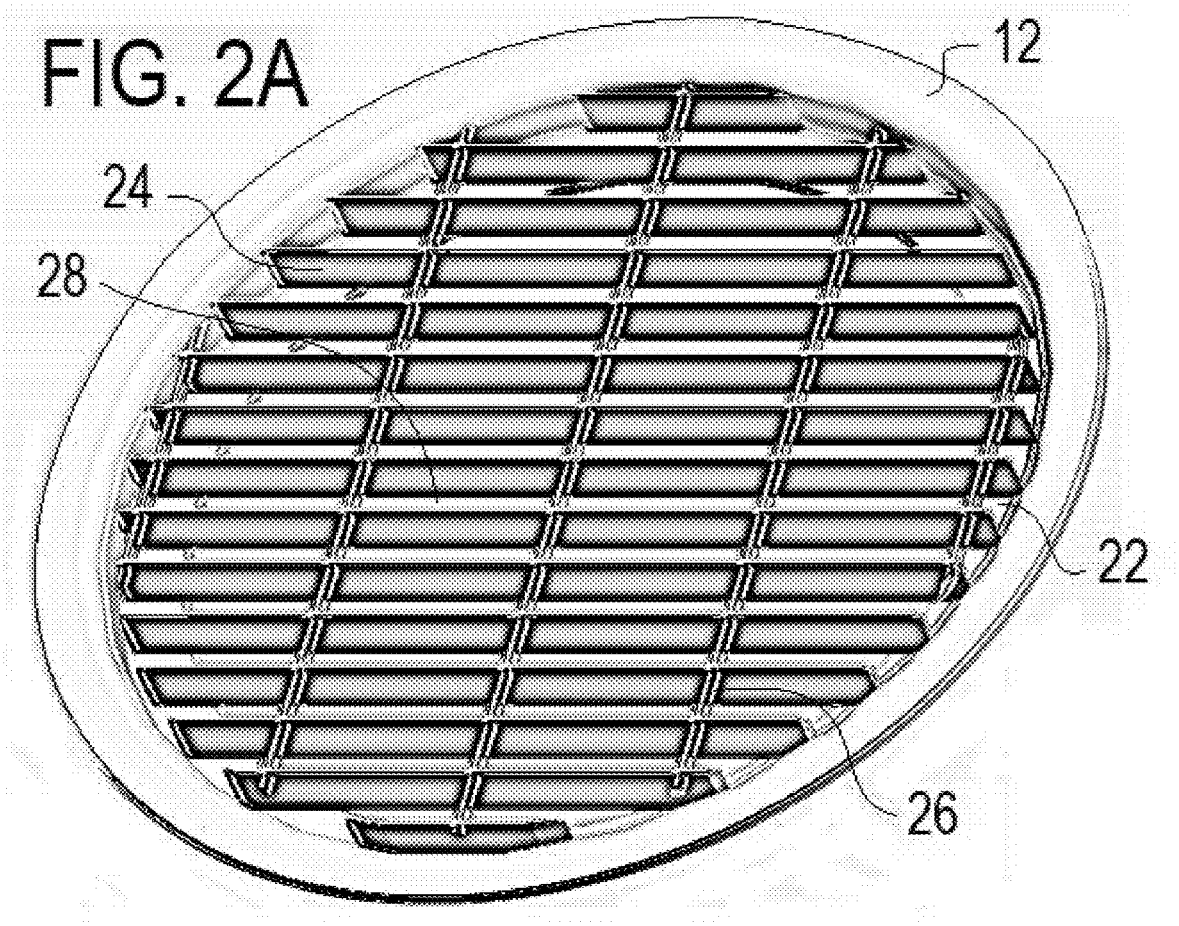
FIG. 2A is a schematic perspective view of a hatch insert according another embodiment of the present invention.
Figure 2B:
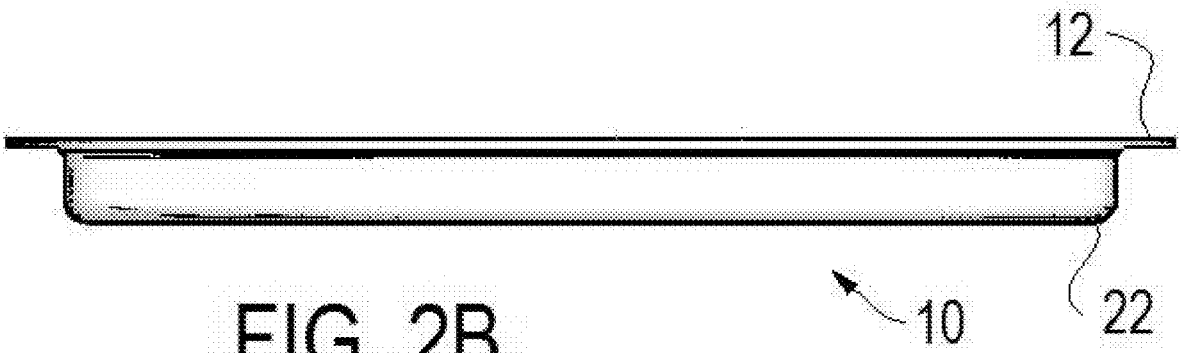
FIG. 2B is a schematic side elevational view of the hatch insert of FIG. 2A.
Figure 2C:
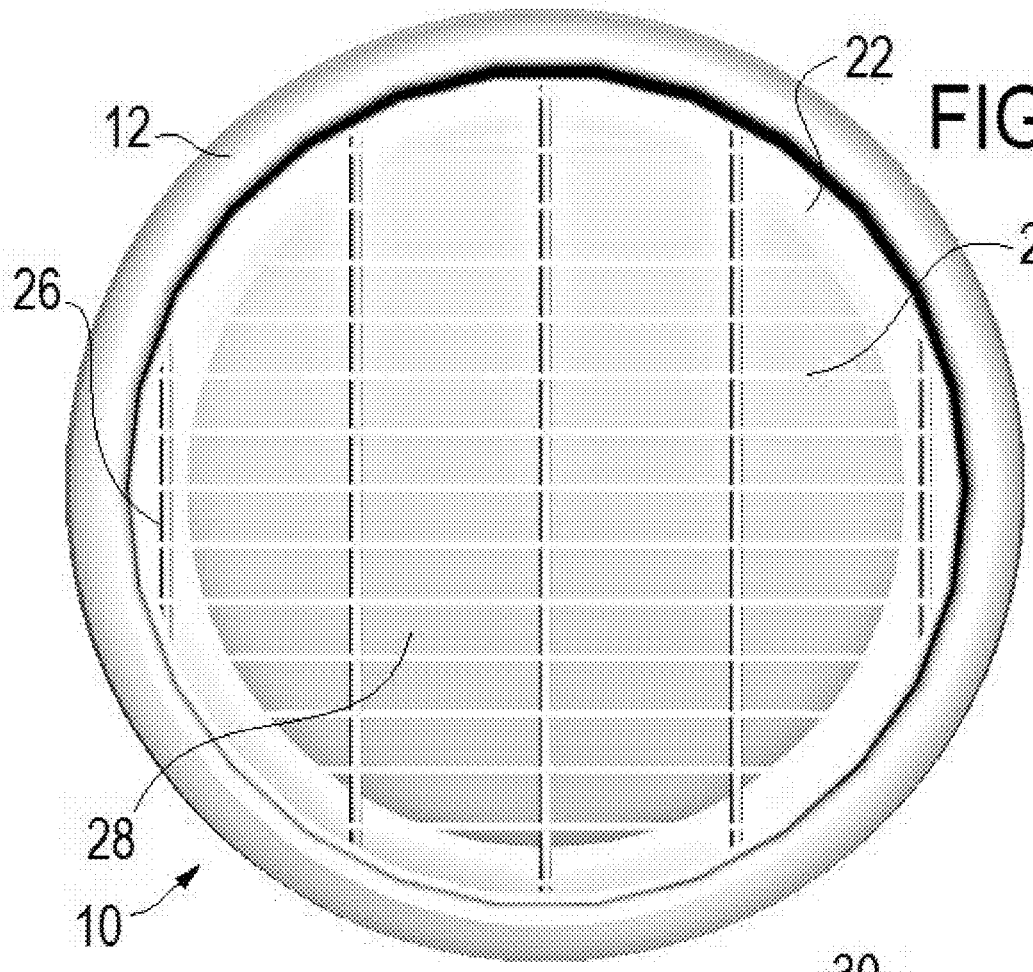
FIG. 2C is a schematic top plan view of the hatch insert of FIG. 2A.

FIG. 2A is a perspective view of a hatch insert 10 according another embodiment of the present invention. FIG. 2B is a side elevational view of the hatch insert of FIG. 2A and FIG. 2C is a top plan view of the hatch insert of FIG. 2A. As noted above the hatch insert 10 according to the present invention has a frame 12 which is sized to be received in a given hatch opening. Coupled to the frame 12 is a grating supporting ledge 22 upon which an insert body formed as an open grate structure, specifically known as bar grating, is supported. The insert body will cover an open area defined by the frame 12. The open grate structure is formed by vertical slats or bearing bars 24 and transverse cross bars or rods 26. The open grate formed by bars 24 and 26 will support a person walking across the insert 10 in the hatch opening. Further the open grate of the hatch insert 10 includes a plurality of generally rectangular openings 28 for venting or ventilation of the void space during servicing of the same. In this version the venting is formed by an open grate type construction of slats 26 and rods 26 to the body of the hatch insert while the frame 12 is formed to fit the hatch opening. The bar grating is known to support heavier loads than plank grating and is known for the open design.

The insert 10 of FIGS. 2A-C may be formed of a single plastic construction or the open grate component could be formed separately and attached thereto. The separate construction of the frame 12 and the open grate body allows for the distinct components to be made of different materials like plastic and metal. The open grate design allows for easy carrying and manual installation and removal of the insert 10. The insert 10 of FIGS. 2A-C operates in the same fashion as the insert 10 of FIGS. 1A-C discussed above.

Figure 3A:
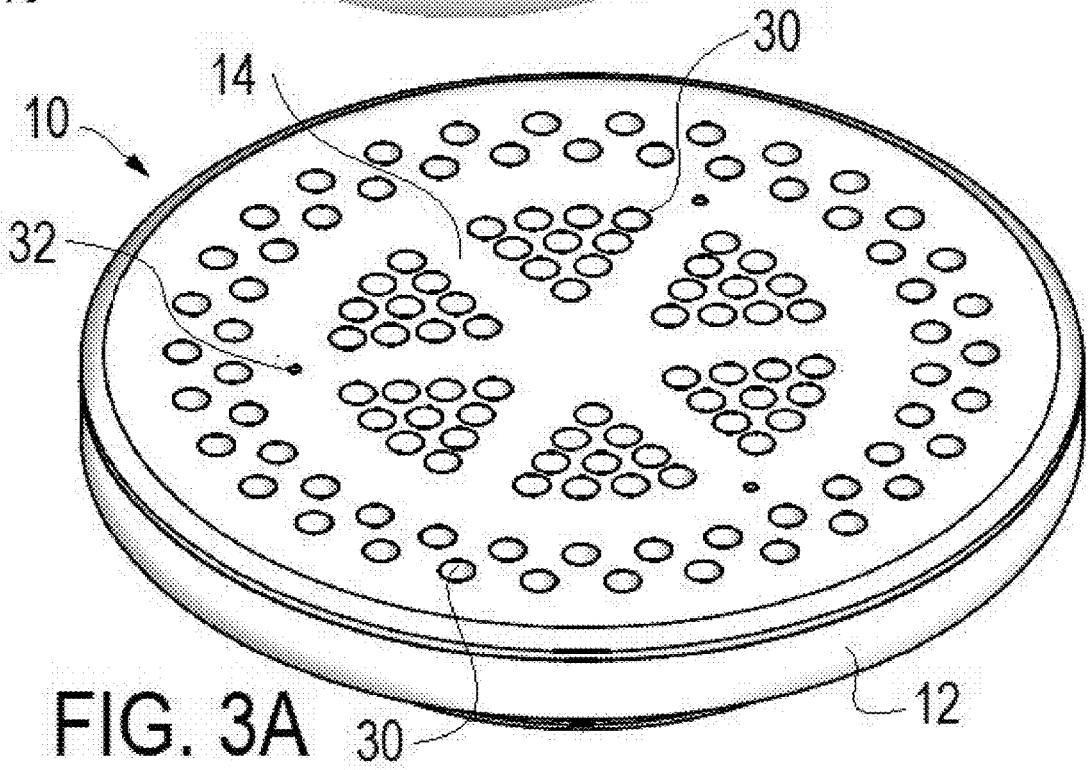
FIG. 3A is a schematic perspective view of a hatch insert according another embodiment of the present invention.

FIG. 3A is a perspective view of a hatch insert according another embodiment of the present invention. FIG. 3B is a top plan view of the hatch insert 10 of FIG. 3A, FIG. 3C is a section view of the hatch insert 10 of FIG. 3B, and FIG. 3D is a bottom plan view of the hatch insert of FIG. 3A. The light weight hatch insert 10 according to the present invention shown in FIGS. 3A-D is similar to that shown in FIGS. 1A-C in that it includes a peripheral frame 12 and a planar insert body 14 extending from the frame 12 and which will support a person walking across the insert 10 in the hatch opening. Further the hatch insert 10 of FIGS. 3A-D includes a plurality of circular openings 30 for venting or ventilation of the void space during servicing of the same. In this version the vent openings are arranged in an inner and an outer annular array. The insert 10 is lightweight as discussed above.

Further in the insert 10 of FIGS. 3A-D there are tapped holes 32 allowing for the attachment of a fan mount or blower mount 40 on the underside of the hatch insert 10 as best shown in FIGS. 3C and 3D. The mounting of the fan or blower (not shown) to this mount 34 will allow for better and positive ventilation of the void space. Generally, in operation with the fan or blower mounted in the mount 34 and in operation, the inner array of holes 30 will pull outside air into or push (vent) void space air out of the void space depending upon the direction of the fan/blower; while the outer array of openings 30 will act in the opposite manner (less so if the void space is not a sealed space). As shown the fan or blower will not interfere with the deck in this configuration. The fan or blower mount can be configured for different fan or blower housings.

It will be evident that various modifications may be made to the present invention without departing from the spirit or scope thereof. For example where the frame of a hatch insert for one hatch opening size fits within the plan outline of one or more larger hatch opening sizes, then the present invention contemplates an adaptor frame that can fit the larger hatch opening size and support the smaller frame, whereby one hatch insert with one or more adaptors can be used to service two or more hatch opening sizes. The present invention is defined by the appended claims and equivalents thereto.

What is claimed:

1. A method of facilitating a barge or boat's void space servicing in a marine environment comprising the steps of a) providing a temporary hatch insert for a given hatch opening of the barge or boat in the marine environment including providing for a given hatch opening of the barge or boat in the marine environment including;
   i) a frame sized to be received in the given hatch opening and defining an open area;
   ii) an insert body extending from the frame and covering the open area and configured to support a person walking on the barge or boat across the insert in the given hatch opening; and
   iii) a plurality of openings through the insert body for venting or ventilation of the barge or boat's void space during servicing of the same;

b) placing the temporary hatch insert within the given hatch opening of the barge or boat during servicing of the void space of the barge or boat accessed by the given hatch opening for support of a person walking on the barge or boat across the insert in the given hatch opening and for venting or ventilation of the void space of the barge or boat during servicing of the same; and c) removing the temporary hatch insert from within the given hatch opening of the barge or boat following servicing of the void space of the barge or boat.

2. The method of facilitating the barge or boat's void space servicing in the marine environment according to claim 1, wherein the placing and removing of the temporary hatch insert is manual.

3. The method of facilitating the barge or boat's void space servicing in the marine environment according to claim 1, wherein the temporary hatch insert weights less than 25 lbs.

4. The method of facilitating the barge or boat's void space servicing in the marine environment according to claim 1, wherein at least one of the openings through the insert body is a handle sized opening near a peripheral edge of the insert body adjacent the frame configured to act as a handhold for carrying, inserting and removing the insert.

5. The method of facilitating the barge or boat's void space servicing in the marine environment according to claim 1, wherein the insert body is a planar plastic plate member.

6. The method of facilitating the barge or boat's void space servicing in the marine environment according to claim 1, wherein the insert body is a color comprising a neon color to draw attention to the insert for those working on the boat or barge.

7. The method of facilitating the barge or boat's void space servicing in the marine environment according to claim 1, further including a fan mount or blower mount on an underside of the hatch insert.

8. The method of facilitating the barge or boat's void space servicing in the marine environment according to claim 1, further including the step of using a fan or blower mounted to the underside of the hatch insert for positive ventilation of the barge or boat's void space.

9. The method of facilitating the barge or boat's void space servicing in the marine environment according to claim 1, wherein the insert body is an open grate structure.

10. The method of facilitating the barge or boat's void space servicing in the marine environment according to claim 9, wherein the insert body includes bar grating.

11. The method of facilitating the barge or boat's void space servicing in the marine environment according to claim 9, wherein the open grate structure is supported on a ledge extending from the frame.

12. A temporary marine hatch insert facilitating a barge or boat void space servicing to be removed following servicing of the boat or barge's void space, the temporary marine hatch insert comprising:

a) a hatch frame sized to be received in a given hatch opening of the barge or boat and defining an open area;

b) an insert body extending from the hatch frame and covering the open area and configured to support a person walking on the barge or boat across the insert in the hatch opening;

c) a plurality of openings through the insert body for venting or ventilation of the void space of the barge or boat during servicing of the same; and d) wherein the temporary hatch insert weighs less than 25 lbs allowing for manual carrying, inserting and removing the insert.

13. The temporary marine hatch insert facilitating the barge or boat void space servicing according to claim 12, wherein at least one of the openings through the insert body is a handle sized opening near a peripheral edge of the insert body adjacent the frame configured to receive an operator's hand to act as a handhold for carrying, inserting and removing the insert.

14. The temporary marine hatch insert facilitating the barge or boat void space servicing according to claim 12, wherein the insert body is a planar plastic plate member of a color comprising a neon color to draw attention to the insert for those working on the boat or barge.

15. The temporary marine hatch insert facilitating the barge or boat void space servicing according to claim 12, further including a fan mount or blower mount on an underside of the hatch insert.

16. The temporary marine hatch insert facilitating the barge or boat void space servicing according to claim 12, wherein the insert body is an open grate structure.

17. The temporary marine hatch insert facilitating the barge or boat void space servicing according to claim 16, wherein the insert body includes bar grating supported on a ledge extending from the frame.

18. A temporary marine hatch insert facilitating a boat or barge's void space servicing to be removed following servicing of the boat or barge's void space, the temporary marine hatch insert comprising:

a peripheral edge of the hatch insert sized to be received in a given hatch opening of the barge or boat and will support a person walking on the barge or boat across the insert in the hatch opening;

a plurality of openings for venting or ventilation of the void space during servicing of the same, wherein at least one of the openings through the insert body is a handle sized opening near the peripheral edge of the insert body adjacent the frame configured to act as a handhold for carrying, inserting and removing the insert;

wherein the temporary hatch insert weights less than 25 lbs allowing for manual carrying, inserting and removing the insert, and is a color comprising a neon color.

19. The temporary marine hatch insert facilitating the boat or barge's void space servicing according to claim 18, further including a fan mount or blower mount on an underside of the hatch insert.

* * * * *